US007284502B1

(12) United States Patent
Dotter

(10) Patent No.: US 7,284,502 B1
(45) Date of Patent: Oct. 23, 2007

(54) METHODS AND APPARATUS FOR A PET DOOR DECORATIVE PANEL SYSTEM

(76) Inventor: Jill Dotter, 6232 W. Riviera Dr., Glendale, AZ (US) 85304

( * ) Notice: Subject to any disclaimer, the term of this patent is extended or adjusted under 35 U.S.C. 154(b) by 0 days.

(21) Appl. No.: 11/366,890

(22) Filed: Mar. 2, 2006

Related U.S. Application Data

(60) Provisional application No. 60/665,607, filed on Mar. 25, 2005.

(51) Int. Cl.
*E06B 7/28* (2006.01)

(52) U.S. Cl. ..... 119/484; 119/501; 49/169

(58) Field of Classification Search ..... 119/484; 52/208, 211, 212; 49/169; 160/180
See application file for complete search history.

(56) References Cited

U.S. PATENT DOCUMENTS

| | | | | | |
|---|---|---|---|---|---|
| 2,758,646 | A | | 8/1956 | Johnson | |
| 4,022,263 | A | * | 5/1977 | Beckett et al. | 160/92 |
| 4,363,192 | A | * | 12/1982 | Soucy | 49/453 |
| 4,787,174 | A | * | 11/1988 | Brown | 49/55 |
| D317,216 | S | * | 5/1991 | Cutrone | D30/109 |
| 5,261,350 | A | * | 11/1993 | Vavrek | 119/484 |
| 5,287,654 | A | | 2/1994 | Davlantes | |
| 5,339,567 | A | * | 8/1994 | Pierpont et al. | 49/55 |
| 5,458,088 | A | | 10/1995 | Owens | |
| 5,603,190 | A | * | 2/1997 | Sanford | 52/202 |
| 5,620,037 | A | * | 4/1997 | Apostolo | 160/118 |
| 5,651,331 | A | * | 7/1997 | Cleri, Jr. | 119/484 |
| 5,786,044 | A | * | 7/1998 | Hauge | 428/8 |
| 5,946,856 | A | | 9/1999 | Davlantes | |
| 6,385,926 | B1 | * | 5/2002 | Kizar | 52/211 |
| 6,510,635 | B1 | * | 1/2003 | Rudolph et al. | 40/658 |
| 6,691,463 | B1 | * | 2/2004 | Richmond | 49/360 |
| 6,691,643 | B1 | * | 2/2004 | Hollins | 119/484 |
| 6,694,683 | B2 | * | 2/2004 | Anderson et al. | 52/204.5 |
| 6,944,990 | B2 | * | 9/2005 | Noyes | 49/169 |
| 7,150,244 | B2 | * | 12/2006 | Dawes | 119/484 |
| 2004/0163316 | A1 | | 8/2004 | Johnson | |
| 2005/0263091 | A1 | * | 12/2005 | Knapp | 119/484 |
| 2006/0179719 | A1 | * | 8/2006 | Christie | 49/169 |

* cited by examiner

*Primary Examiner*—Teri Pham Luu
*Assistant Examiner*—Joseph W Sanderson
(74) *Attorney, Agent, or Firm*—Lawrence Letham; Letham Law Firm LLC

(57) ABSTRACT

A pet door decorative panel system configured to decoratively cover a pet door frame while enabling ingress and egress. The exemplary pet door decorative panel system comprises a pet door, the object in which the pet door is mounted, a pet door decorative panel, and a mounting rail.

20 Claims, 6 Drawing Sheets

METHODS AND APPARATUS FOR A PET DOOR DECORATIVE PANEL SYSTEM

CROSS-REFERENCE TO RELATED APPLICATIONS

This application claims priority to, and the benefits of, U.S. provisional application Ser. No. 60/665,607 filed on Mar. 25, 2005, which is hereby incorporated by reference in its entirety.

BACKGROUND OF THE INVENTION

1. Field of the Invention

This invention pertains generally to methods and apparatus relating to pet door decorative panel systems.

2. Description of Related Art

Decorative panel systems find uses in a variety of situations such as, for example, house siding, home decorations, office environments, and pet door décor. A pet door decorative panel system may substantially benefit from a system that is easy to mount, easily changeable, and has an aperture that enables the pet door to be secured against ingress or egress without removing the decorative panel.

BRIEF SUMMARY OF THE INVENTION

Methods and apparatus according to various exemplary embodiments of the present invention comprise a pet door decorative panel configured to slidably interface with mounting rails. In one embodiment, the pet door decorative panel system comprises a panel having an aperture, a surface, at least one groove, and at least one mounting rail having a base and a flange configured to slidably engage the groove. In another embodiment, the pet door decorative panel system comprises a panel having an aperture, a surface, at least one groove, a security slot, and at least one mounting rail having a base and a flange configured to slidably engage the groove.

BRIEF DESCRIPTION OF THE DRAWINGS

A more complete understanding of the present invention may be derived by referring to the detailed description and claims when considered in connection with the figures, wherein like reference numbers refer to similar elements throughout the figures, and:

DETAILED DESCRIPTION OF EXEMPLARY EMBODIMENTS

Figure 1:
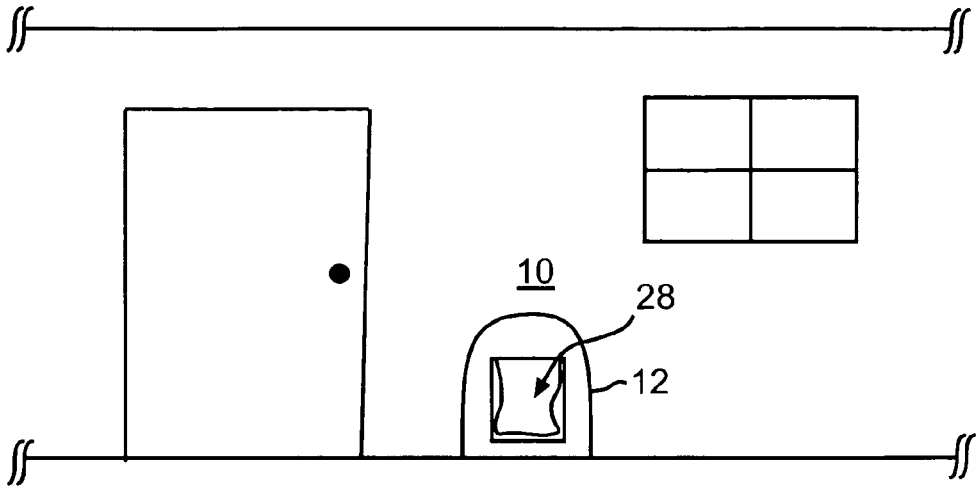
FIG. 1 is a diagram of a mounted pet door decorative panel system in accordance with one embodiment of the present invention.
Figure 2:
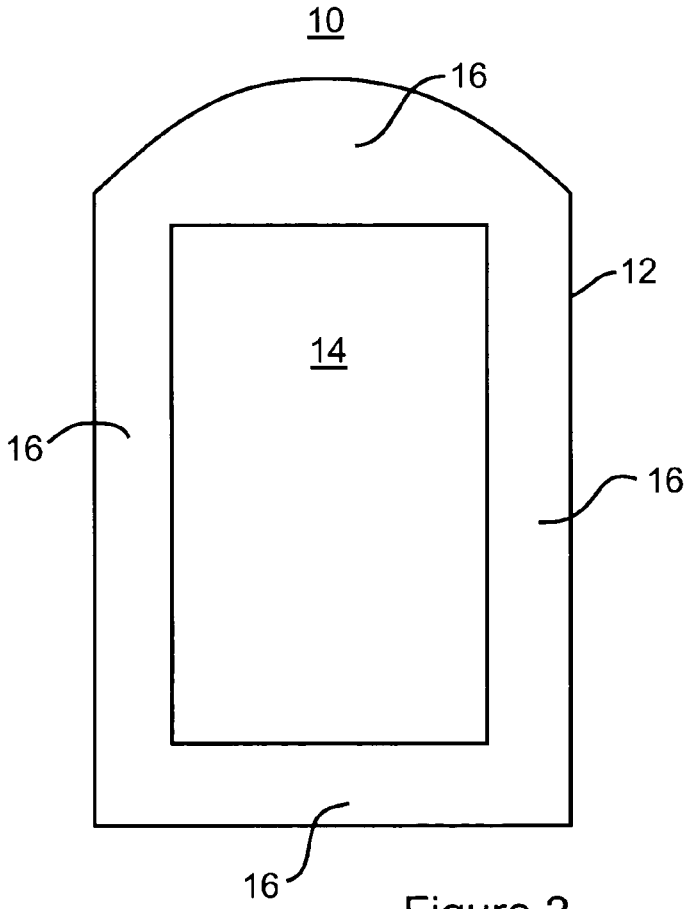
FIG. 2 is a diagram of a front view of a pet door decorative panel in accordance with one embodiment of the present invention.
Figure 3:
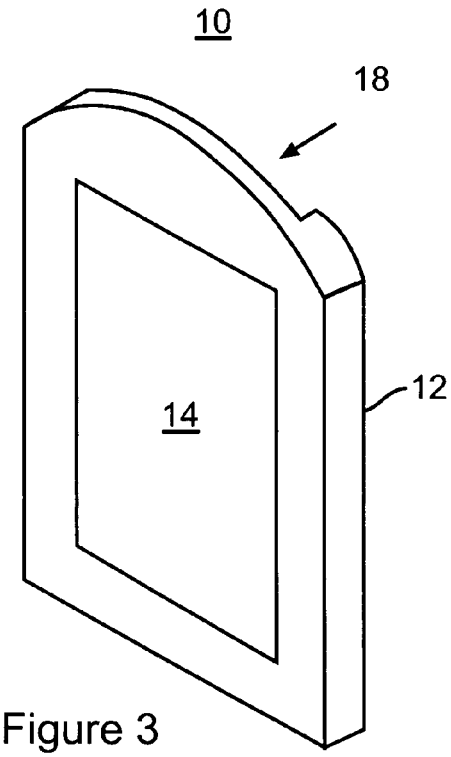
FIG. 3 is a diagram of a top perspective view of a pet door decorative panel in accordance with one embodiment of the present invention.
Figure 4:
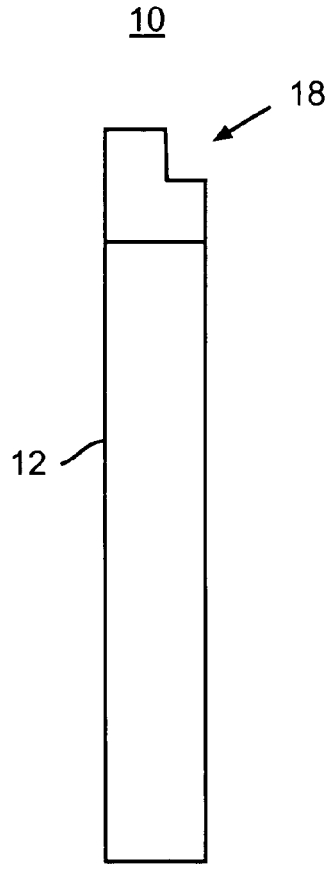
FIG. 4 is a diagram of a side view of a pet door decorative panel in accordance with one embodiment of the present invention.
Figure 5:
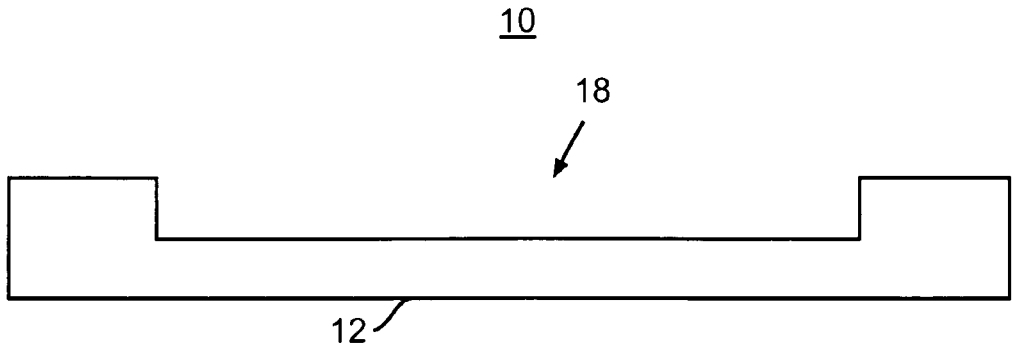
FIG. 5 is a diagram of a top view of a pet door decorative panel in accordance with one embodiment of the present invention.
Figure 6:
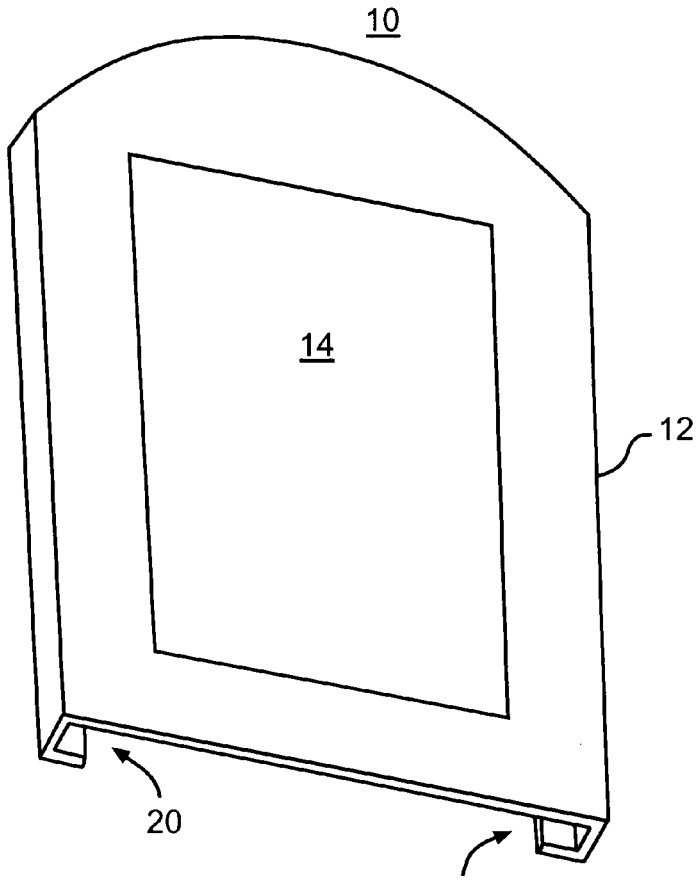
FIG. 6 is a diagram of a front bottom perspective view of a pet door decorative panel in accordance with one embodiment of the present invention.
Figure 7:
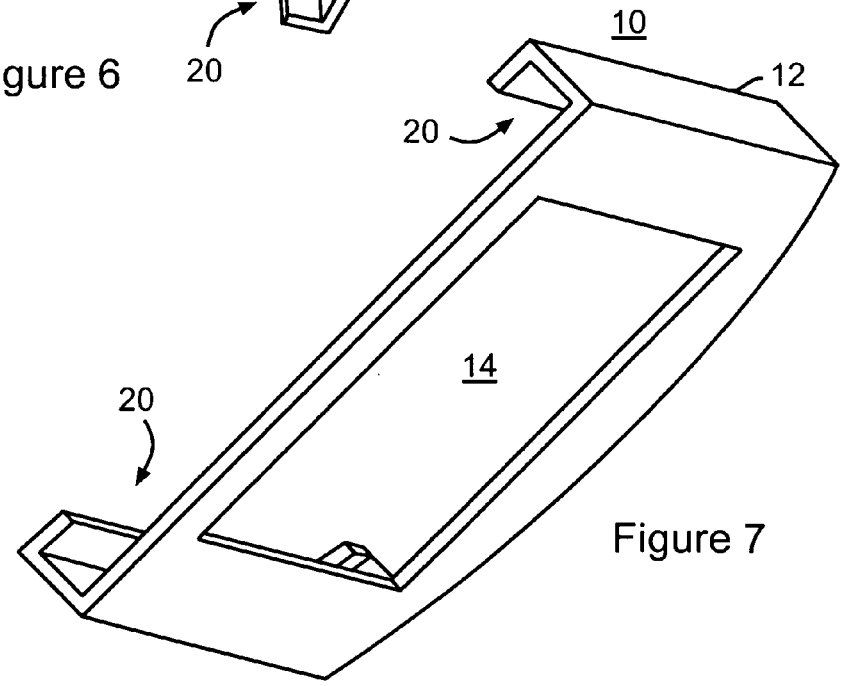
FIG. 7 is a diagram of a front bottom perspective view from an angle different from the angle of FIG. 6 of a pet door decorative panel in accordance with one embodiment of the present invention.
Figure 8:
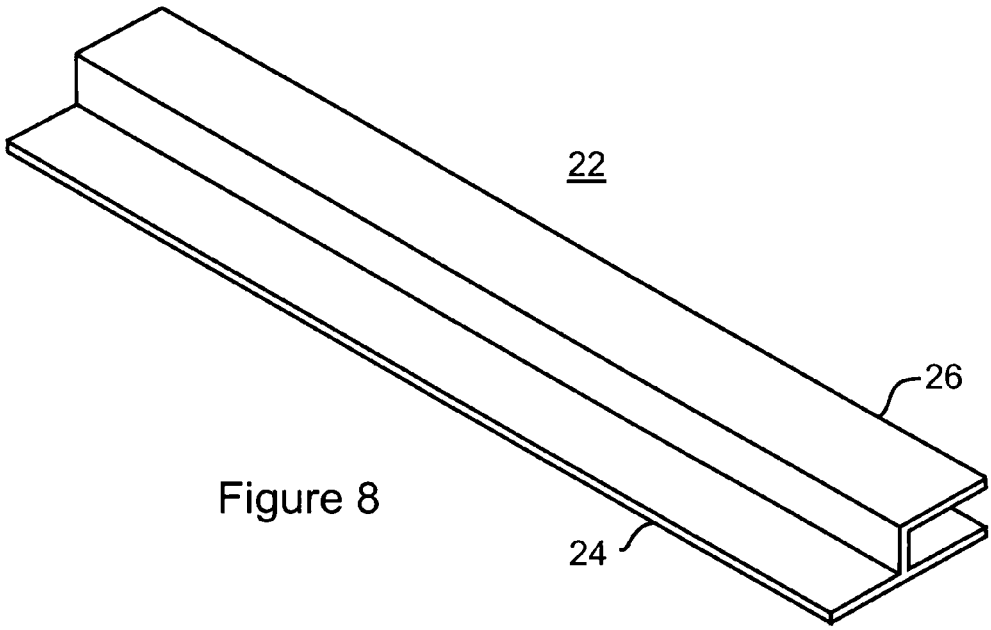
FIG. 8 is a diagram of a perspective view of a mounting rail in accordance with one embodiment of the present invention.
Figure 9:
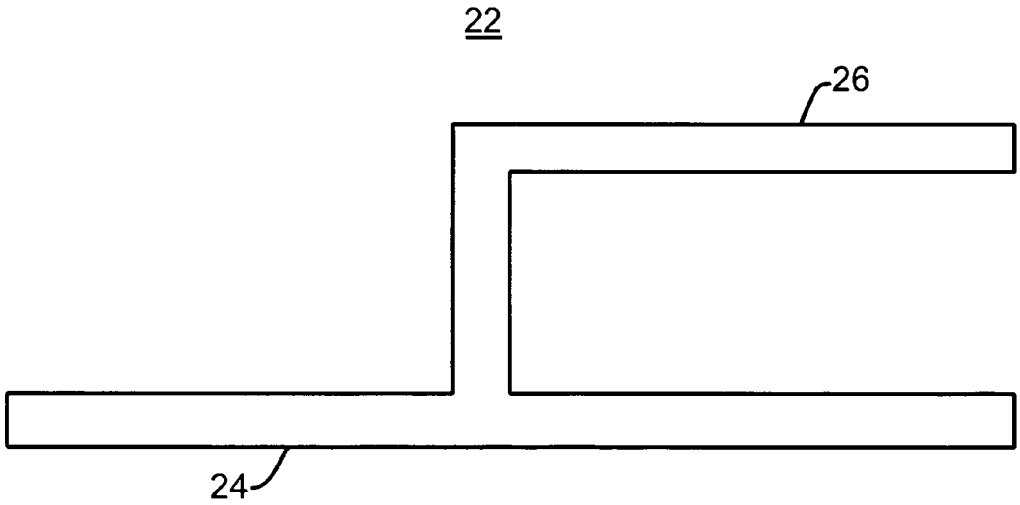
FIG. 9 is a diagram of an end view of a mounting rail in accordance with one embodiment of the present invention.

The accompanying drawings show exemplary embodiments by way of illustration and best mode. While these exemplary embodiments are described, other embodiments may be realized and changes may be made without departing from the spirit and scope of the invention. Thus, the detailed description is presented for purposes of illustration only and not by way of limitation. For example, the steps recited in any of the method or process descriptions may be executed in any suitable order and are not limited to the order presented.

For the sake of brevity, conventional mechanical aspects and components of the individual operating components may not be described in detail. Furthermore, the representations of the various components are intended to represent exemplary functional relationships, positional relationships, and/or physical couplings between the various elements. Many alternative or additional functional relationships, physical relationships, or physical connections may be present in a practical system. The present invention may be embodied as a customization of an existing system, or an add-on product.

The present invention is described partly in terms of functional components and various methods. Such functional components may be realized by any number of components configured to perform the specified functions and achieve the various results. For example, the present invention may be formed using a variety of materials, such as, aluminum, anodized aluminum, electropolated metals, steel, stainless steel, brass, titanium, iron, bronze alloy, plastic, extruded plastics, wood, laminated woods, poly vinyl chloride, acrylonitrile butadiene styrene, polyethylenes, plastisols, polymers, thermoplastics, ceramic, composite materials, nanomaterials, and any other material or combination thereof that may be suitable for an application or environment. The mounting rail may be configured to mount to any type of surface in any manner suitable for the application or environment. The mounting rail base may be of any length, width, thickness, or shape. The mounting rail flange may be of any contour, size, or shape. The pet door decorative panel may be of any size, shape, or thickness. The pet door decorative panel surface may be decorated in any manner. The grooves may be integrated into the pet door decorative panel and/or attached to the pet door decorative panel in any manner. The grooves may be of any shape suitable to slidably engage with the mounting rail. The security slot may be of any width and/or depth to enable the passage of a security panel. The pet door decorative panel may be solid or perforated. The pet door decorative panel may have at least one aperture. A pet door decorative panel having an aperture may interface with an opening of any type, for example, a pet door, a window, and a garage door.

In addition, the present invention may be practiced in conjunction with any number of applications and environments, and the systems described are merely exemplary applications of the invention. Further, the present invention may employ any number of conventional techniques for manufacture, decorating, testing, connecting, mounting, and repair.

Methods and apparatus according to various exemplary embodiments of the present invention comprise a pet door decorative panel system configured to enable a pet door decorative panel having grooves to slidably interface with at least one mounting rail. The mounting rails may be mounted on any object. The mounting rails may be positioned to align with the grooves on the pet door decorative panel. The grooves of the pet door decorative panel may be placed at one end of the mounting rails and slid across the mounting rails until the pet door decorative panel is in position. The mounting rails hold the pet door decorative panel in place. The pet door decorative panel may be removed by sliding the panel until the grooves no longer engage the mounting rail. The pet door decorative panel may have an aperture. A pet door decorative panel having an aperture may allow ingress or egress through an opening in the object upon which the mounting rails are mounted. For example, the object to which the mounting rails are mounted may be a wall, a door, a sliding door, a window, a window frame, a garage door, and a pet door. In one embodiment, a pet door is mounted in a wall. The pet door is installed such that animals pass through the wall by way of the opening in the pet door. A mounting rail is mounted on the wall along each side of the pet door. The pet door decorative panel, having an aperture that substantially corresponds in size to the aperture in the pet door, engages with and slides over the mounting rails. The pet door decorative panel slides into and is held in a position such that the aperture in the pet door decorative panel substantially aligns with the aperture in the pet door. The surface of the pet door decorative panel substantially covers the pet door frame around the pet door aperture. The pet door decorative panel may also have a security slot that may allow a security panel to slidably cover the pet door aperture. In one embodiment, the security slot is in the top of the pet door decorative panel. In another embodiment, the security slot is in a side of the pet door decorative panel.

Figure 10:
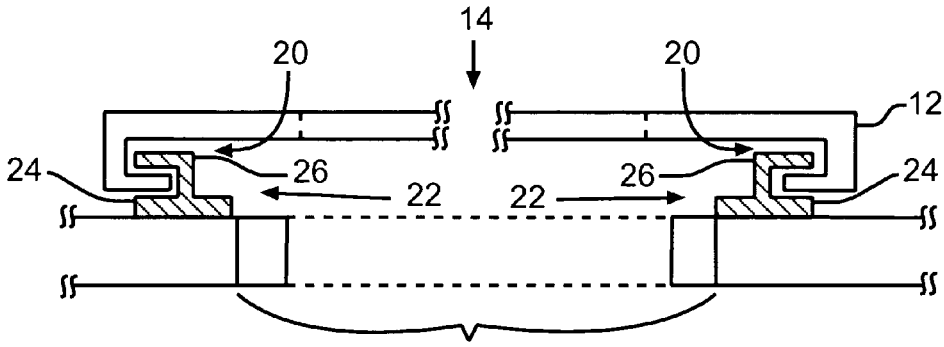
FIG. 10 is a diagram of a bottom view of a pet door decorative panel system in accordance with one embodiment of the present invention.

In particular, referring to FIGS. 1-10, a pet door decorative panel system 10 according to various exemplary embodiments of the present invention comprises a pet door decorative panel 12 and at least one mounting rail 22. The pet door decorative panel 12 having a surface 16, and aperture 14, a security slot 18, and two grooves 20. Mounting rail 22, referring to FIG. 8, comprises a base 24 and a flange 26 configured to slidably engage with groove 20. In an exemplary embodiment, referring to FIGS. 1 and 10, a mounting rail 22 is mounted vertically along each side of pet door 28. The mounting rail 22 may be mounted to the pet door 28 frame and/or to the surface adjacent to pet door 28 such as, for example, a wall, a door, a sliding door, a garage door, and a window. Pet door decorative panel 12 is placed in position by holding pet door decorative panel 12 above the pet door 28 such that grooves 20 engage with mounting rails 22 as depicted in FIG. 10. Grooves 20 of pet door decorative panel 12 slide along mounting rails 22 until the pet door decorative panel 12 reaches a final position in which the aperture 14 is substantially aligned with the pet door aperture. Bumps and/or extrusions (not shown) may be placed on the surface of groove 20 and/or mounting rail 22 to enable groove 20 to better grip mounting rails 22, thereby retaining pet door decorative panel 12 in a position. In an exemplary embodiment, the pet door decorative panel 12 is removed by sliding pet door decorative panel 12 up until the grooves 20 disengage from the mounting rails 22. When the pet door decorative panel 12 is in the final position, referring to FIGS. 1 and 3-5, a security panel (not shown), may be placed in security slot 18, and slid down until aperture 14 is substantially obstructed, thereby stopping ingress and/or egress through pet door 28. The security panel may be inserted and removed from security slot 18 without removing pet door decorative panel 12 from mounting rails 22. The security panel may engage the frame of pet door 28. In one embodiment, the security panel engages with the pet door 28 frame and security slot 18 allows the security panel access to the pet door 28 frame. In another embodiment, mounting rails 22 have a second flange (not shown) adapted to receive and hold the security panel without engaging with the pet door 28 or the pet door 28 frame. In another embodiment, pet door decorative panel 12 does not have security slot 18. Mounting ail 22 is adapted to position the pet door decorative panel 12 with enough room between pet door decorative panel 12 and pet door 28 such that the security panel (not shown) is placed behind the pet door decorative panel 12 and into pet door 28.

Figure 11:
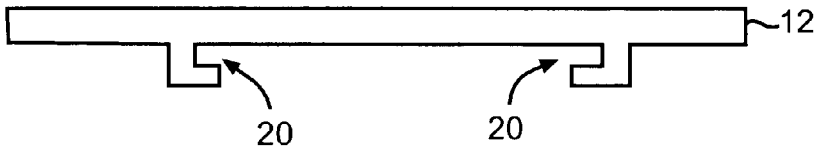
FIG. 11 is a diagram of a bottom view of a pet door decorative panel in accordance with one embodiment of the present invention.
Figure 14:
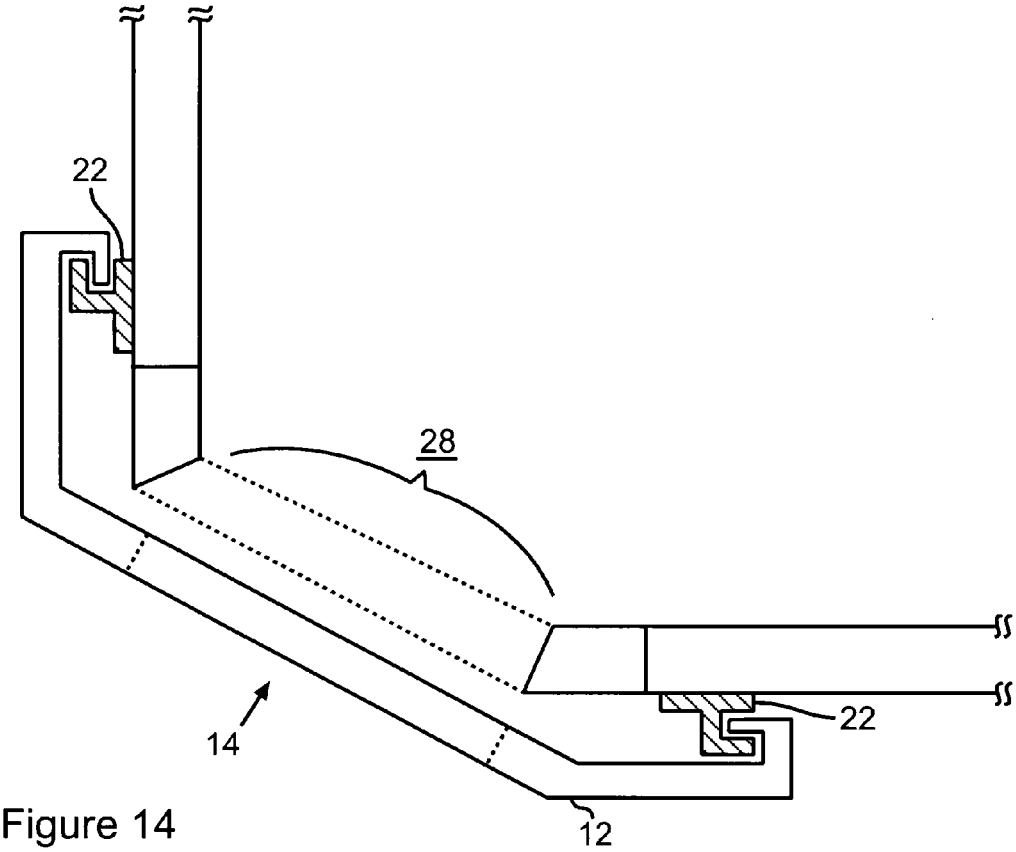
FIG. 14 is a diagram of a bottom view of a pet door decorative panel system in accordance with one embodiment of the present invention; and, FIG. 15 is a diagram of a front view of a pet door decorative panel system in accordance with one embodiment of the present invention.
Figure 15:
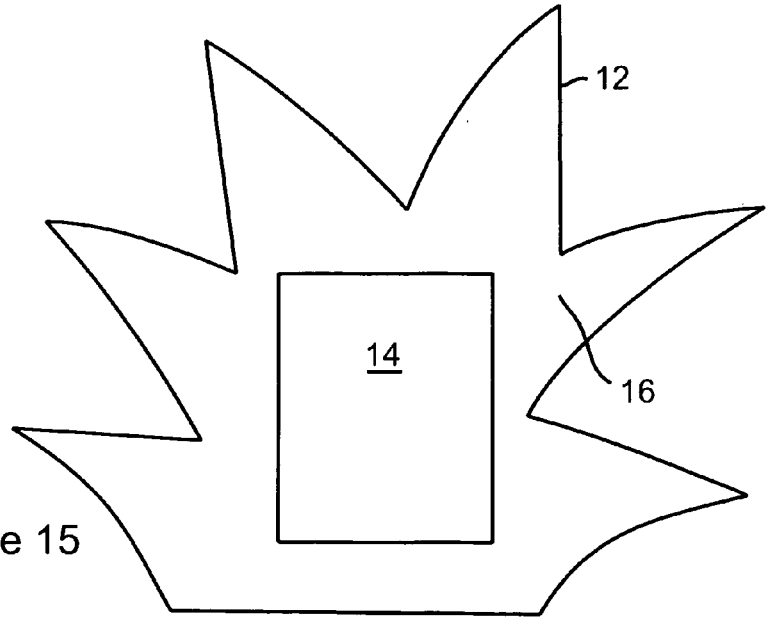

With respect to the pet door decorative panel 12, pet door decorative panel 12 may be of any material, shape, size, thickness, and configuration for an application or environment. The pet door decorative panel 12 may use any material or combination of materials suitable for an application or environment, for example, aluminum, anodized aluminum, electropolated metals, steel, stainless steel, brass, titanium, iron, bronze alloy, plastic, extruded plastics, wood, laminated woods, poly vinyl chloride, acrylonitrile butadiene styrene, polyethylenes, plastisols, polymers, thermoplastics, ceramic, composite materials, and nanomaterials. In one embodiment, referring to FIG. 2, surface 16 of pet door decorative panel 12 is solid and pet door decorative panel has one aperture 14. Aperture 14 may be of any size and/or shape suitable for an application or environment. In an exemplary embodiment, aperture 14 is substantially similar in size and shape to the aperture of a pet door 28 such that aperture 14 substantially aligns with pet door 28 aperture and not impede the movement of a flexible flap that may be associated with pet door 28. Surface 16, referring to FIG. 2, of pet door decorative panel 12 may be decorated in any manner, for example, the panel may be painted, engraved, etched, carved in relief, contain extruded patterns, be covered with appliqués, have drawings and/or photographs adhered to the surface, and decorative patterns applied to the surface in any suitable manner. Surface 16 may be solid or porous. Pet door decorative panel 12 may be any color suitable to the material and/or the application. Grooves 20 may be of the same material as pet door decorative panel 12 and/or integrated with pet door decorative panel 12 or grooves 20 may be formed separately from pet door decorative panel 12 and mounted to pet door decorative panel 12 in any suitable manner. In an exemplary embodiment, referring to FIGS. 6-7, grooves 20 is made of the same material as pet door decorative panel. One groove 20 is formed on each side edge of pet door decorative panel 12. Groove 20 may be located at any position on pet door decorative panel 12. In an exemplary embodiment, referring to FIGS. 6 and 10, a groove 20 is located on each side edge of pet door decorative panel 12. In another embodiment, referring to FIGS. 11 and 13, grooves 20 are located on the back of pet door decorative panel 12 away from the edges. Pet door decorative panel 12 may be of any shape, for example, substantially square, rectangular, circular, oval, angular, and arbitrarily shaped. In an exemplary embodiment, referring to FIG. 2, pet door decorative panel 12 is substantially rectangular with an arched top. In another embodiment, referring to FIG. 14, pet door decorative panel 12 is substantially angular. In another embodiment, referring to FIG. 15, pet door decorative panel 12 is substantially arbitrary in shape.

With respect to the surface of pet door decorative panel 12. Surface 16 of pet door decorative panel 12 may be prepared in any manner suitable to an application or environment. For example, surface 16 may be left in a raw state, it may be prepared, milled, painted, glued, extruded, stretched, melted, carved, etched, engraved and/or any material may be adhered to surface 16 such as paper, photographic prints, or the like. In an exemplary embodiment, pet door decorative panel 12 is plastic and decorative patterns are extruded in surface 16. In another embodiment, surface 16 is prepared to accept and adhere to appliqués applied with an adhesive.

With respect to aperture 14, aperture 14 may be of any size and/or shape. Pet door decorative panel 12 may have one aperture 14 or many apertures 14 of varying sizes and/or shapes. Aperture 14 may be covered with any material suitable to an application or environment. For example, aperture 14 may be covered with Mylar film, plastic, cloth, glass, acrylic, vinyl, and rubber. The covering may be of any color, thickness, and decorative scheme. The covering may attach to one or more sides of aperture 14. For example, in one embodiment, a flexible plastic sheet is attached to the top of aperture 14 such that the plastic sheet returns to a substantially vertical position that substantially covers aperture 14 after ingress and/or egress. In an exemplary embodiment, referring to FIGS. 1-2, aperture 14 is substantially rectangular and has no covering. In another embodiment, aperture 14 is obstructed by a security panel.

Figure 13:
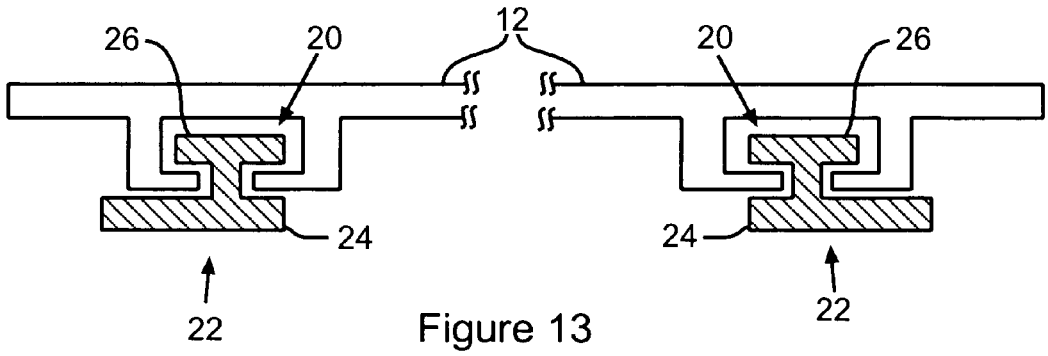
FIG. 13 is a diagram of a bottom view of a pet door decorative panel system in accordance with one embodiment of the present invention.

With respect to grooves 20, grooves 20 may be of any depth, width, shape, or length for an application or an environment. The grooves 20 may be formed of the material that forms the pet door decorative panel 12 and may be integrated with the pet door decorative panel 12 during manufacture or grooves 20 may be formed of any material and mounted to the pet door decorative panel 12 in any suitable manner. In an exemplary embodiment, referring to FIGS. 6-7, grooves 20 are formed of the same material as pet door decorative panel 12 and are located substantially on the side edges of pet door decorative panel 12. In an exemplary embodiment, referring to FIG. 3, the grooves 20 extend substantially the entire length of the pet door decorative panel 12 from the bottom until the beginning of the arched top. In another embodiment, grooves 20 extend only part of the way along the side edge of the pet door decorative panel 12. The grooves 20 may be of any shape, for example, substantially rectangular, square, round, and oval. In an exemplary embodiment, referring to FIG. 7, the grooves 20 are substantially rectangular. In another embodiment, referring to FIG. 13, the grooves 20 are substantially enclosed rectangles. Referring to FIGS. 13 and 10, flange 26 of mounting rail 22 may fit substantially into groove 20 to allow sliding of the groove 20 along the flange 26 for positioning the pet door decorative panel 12. The shape of the groove 20 may be adapted to the shape of the flange 26 to enable the mounting rail 22 to substantially hold the pet door decorative panel 12 in a position. The surface and/or shape of the grooves 20 may be formed in any manner to provide a secure fit with mounting rails 22. In one embodiment, bumps are placed on the surface of groove 20 to provide a tighter fit with mounting rail 22.

With respect to security slot 18, security slot 18 may be any width, depth, or shape for an application or environment. Security slot 18 may be a single slot or multiple slots. The security slot 18 may be located in the top and/or either side of the pet door decorative panel 12. In an exemplary embodiment, referring to FIGS. 3-5, the security slot is positioned in the top of the pet door decorative panel 12 and is about as wide as the width of the aperture 14. In another embodiment, guide rails having grooves the width of the thickness of the security panel are positioned along at least a portion of the sides of aperture 14 to guide and substantially secure the security panel when inserted. In another embodiment, the security panel attaches to the pet door 28 frame and security slot 18 provides access to insert and remove the security panel from the pet door 28 without removing pet door decorative panel 12. In another embodiment, pet door decorative panel 12 does not have security slot 18 and the security panel is positioned behind pet door decorative panel 12.

Figure 12:
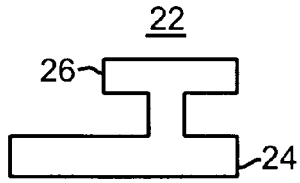
FIG. 12 is a diagram of an end view of a mounting rail in accordance with one embodiment of the present invention.

With respect to the mounting rail 22, mounting rail 22 may be of any material, shape, size, thickness, and configuration for an application or environment. The mounting rail 22 may use any material or combination of materials suitable for an application, for example aluminum, anodized aluminum, electroplated metals, steel, stainless steel, brass, titanium, iron, bronze alloy, plastic, extruded plastics, wood, laminated woods, poly vinyl chloride, acrylonitrile butadiene styrene, polyethylenes, plastisols, polymers, thermoplastics, ceramic, composite materials, and nanomaterials. In an exemplary embodiment, referring to FIGS. 8 and 9, mounting rail 22 comprises a base 24 and a flange 26. Base 24 may be configured to mount to any type of material using any suitable mounting mechanism for an application or environment. For example, the base may be mounted using glue, bolts, nails, screws, wall anchors, Velcro, snaps, tape, welding, or any combination thereof. In an exemplary embodiment, the base 24 is screwed to the material and/or object adjacent to a pet door. In another embodiment, the base 24 mounts to sheet rock by nails that pass through the base 24, through the sheet rock and into a wooden stud. In another embodiment, base 24 mounts to metal by a self-tapping screw that passes through the base 24 and into the metal. In another embodiment, base 24 mounts to the pet door 28 frame. The flange 26 may be of any material, thickness, length, or shape. The flange 26 may be manufactured as one piece with the base or the flange 26 may be manufactured separately from the base 24 and secured to the base 24 in any manner. In an exemplary embodiment, the mounting rail 22 is extruded plastic with the base 24 and the flange 26 formed as a single, integrated piece. In another embodiment, mounting rail 22 is formed from metal. In another embodiment, base 24 and flange 26 of the mounting rail 22 are milled from a single piece of material. In an exemplary embodiment, the flange 26 extends the entire length of the mounting rail 22. In another embodiment, flange 26 extends only part of the length of mounting rail 22. The flange 26 may be of any shape, for example, rectangular, square, circular, triangular, similar in shape to an "L," similar in shape to a "T," similar in shape to a "Z," and similar in shape to an "H." In an exemplary embodiment, referring to FIG. 9, flange 26 is substantially rectangular and adapted to grip groove 20. In another embodiment, referring to FIGS. 12-13, flange 26 is substantially "T" shaped. Flange 26 may be coated with a dry lubricant and/or laminated with a material likely to decrease friction between the flange 26 and the groove 20 or flange 26 may be coated with a material to increase the adherence between flange 25 and groove 20. In one embodiment, bumps are formed into flange 26 to enable flange 26 to engage and hold groove 20 in a position.

What is claimed is:

1. A pet door panel system for covering a frame of a provided pet door, the pet door mounted to a structure, the pet door having a first aperture that permits passage through the structure, the pet door panel system comprising:

a first rail having a base and a flange, the base of the first rail mounted to at least one of the structure and the frame on a first side of the pet door;

a second rail having a base and a flange, the second rail separate from the first rail, the base of the second rail mounted to at least one of the structure and the frame on a second side of the pet door, the second side opposite the first side, the first rail and the second rail not coupled to each other prior to mounting;

a panel having a first groove, a second groove, and a second aperture, the first groove couples to the flange of the first rail, the second groove couples to the flange of the second rail, the panel slidably moves along the first rail and the second rail until the second aperture substantially aligns with the first aperture, the second aperture permitting passage through the first aperture, the panel substantially covering the frame.

2. The pet door panel system of claim 1, wherein a shape of the panel is substantially rectangular with an arched top.

3. The pet door panel system of claim 1, wherein a shape of at least one of the flanges is substantially at least one of rectangular, square, circular, triangular, similar to an "L," similar to a "T," similar to a "Z," and similar to an "H."

4. The pet door panel system of claim 1, wherein each of the grooves is positioned on at least one of a side edge, parallel to a side edge, a top edge, a bottom edge, and the back of the panel.

5. The pet door panel system of claim 1, further comprising a security panel slidably positioned between the panel and the pet door, wherein the security panel blocks the first and second apertures.

6. The pet door panel system of claim 1, further comprising a slot in the panel that accepts a security panel, wherein the slot positions the security panel between the panel and the pet door, the security panel blocking the first and second apertures.

7. The pet door panel system of claim 1, wherein a surface of the panel is adapted to display decorative designs.

8. The pet door panel system of claim 1, further comprising a bump in each of the grooves, wherein the bump contacts the respective flange, thereby facilitating retention of the panel in a position.

9. A pet door panel system for covering a frame of a provided pet door, the pet door mounted to a structure, the pet door having a first aperture that permits passage through the structure, the pet door panel system comprising:

a panel having a shape, a surface, a second aperture, and at least one groove;

a mounting rail for each groove, the mounting rail having a base and a flange, wherein the flange slidably engages the groove and retains the panel in a position; and a security slot in the panel, whereby a security panel enters the security slot and blocks at least one the first aperture and the second aperture.

10. A pet door panel system for covering a frame of a pet door, the pet door panel system comprising:

a pet door mounted in a structure, the pet door having a frame and a first aperture that permits passage through a second aperture in the structure;

a first rail having a base and a flange, the base of the first rail mounted to at least one of the structure and the frame on a first side of the pet door;

a second rail having a base and a flange, the second rail separate from the first rail, the base of the second rail mounted to at least one of the structure and the frame on a second side of the pet door, the second side opposite the first side, the first rail and the second rail not coupled to each other prior to mounting;

a panel having a first groove, a second groove, and a third aperture, the first groove couples to the flange of the first rail, the second groove couples to the flange of the second rail, the panel slidably moves along the first rail and the second rail until the third aperture substantially aligns with the first aperture, the third aperture permitting passage through the first aperture and the second aperture, the panel substantially covering the frame.

11. The pet door panel system of claim 10, wherein the structure comprises at least one of a wall, a door, a garage door, a sliding door, and a window.

12. The pet door panel system of claim 10, wherein a shape of the flange is substantially at least one of rectangular, square, circular, triangular, similar to an "L," similar to a "T," similar to a "Z," and similar to an "H."

13. The pet door panel system of claim 10, wherein each of the grooves is positioned on at least one of a side edge, parallel to a side edge, a top edge, a bottom edge, and on a back of the panel.

14. The pet door panel system of claim 10, further comprising a security panel slidably positioned between the panel and the pet door, wherein the security panel blocks the first, second, and third apertures.

15. The pet door panel system of claim 10, wherein the first rail and the second rail are adapted to hold the panel in a position that facilitates sliding a security panel between the panel and the pet door to block the first aperture.

16. The pet door panel system of claim 10, wherein a shape of the panel is substantially rectangular with an arched top.

17. The pet door panel system of claim 10, further comprising a slot in the panel that accepts a security panel, wherein the slot positions the security panel between the panel and the pet door, the security panel blocking the first, second, and third apertures.

18. The pet door panel system of claim 10, further comprising a bump in each of the grooves, wherein the bump contacts the respective flange, thereby facilitating retention of the panel in a position.

19. The pet door panel system of claim 10, wherein a surface of the panel is adapted to display decorative designs.

20. A pet door panel system comprising:

an object having an aperture;

a pet door having a frame and an aperture, wherein the frame mounts to the object and the pet door aperture substantially aligns with the object aperture;

a panel having a shape, a surface, an aperture, and at least one groove; and, a mounting rail for each groove, the mounting rail having a base and a flange, wherein the base mounts to the object, wherein the flange slidably engages the groove and retains the panel in a position wherein the panel aperture substantially aligns with the pet door aperture;

a security slot in the panel, whereby a security panel enters the security slot and blocks at least one of the pet door aperture and the panel aperture.

* * * * *